US011001980B2

(12) United States Patent
Bannerman et al.

(10) Patent No.: US 11,001,980 B2
(45) Date of Patent: May 11, 2021

(54) ROAD CLEARING APPARATUS

(71) Applicants: Gregory Dale Bannerman, Meadow Lake (CA); Annette Lee Bannerman, Meadow Lake (CA)

(72) Inventors: Gregory Dale Bannerman, Meadow Lake (CA); Annette Lee Bannerman, Meadow Lake (CA)

( * ) Notice: Subject to any disclaimer, the term of this patent is extended or adjusted under 35 U.S.C. 154(b) by 145 days.

(21) Appl. No.: 16/400,507

(22) Filed: May 1, 2019

(65) Prior Publication Data

US 2020/0347566 A1 Nov. 5, 2020

(51) Int. Cl.
*E01H 5/06* (2006.01)
*E01H 5/12* (2006.01)

(52) U.S. Cl.
CPC ..... *E01H 5/068* (2013.01); *E01H 5/12* (2013.01)

(58) Field of Classification Search
CPC ..... E01H 5/068; E01H 5/12
USPC ..... 37/268; 404/96
See application file for complete search history.

(56) References Cited

U.S. PATENT DOCUMENTS 2,690,902 A * 10/1954 Ream ..... E01H 5/12 37/236
4,793,733 A * 12/1988 Chiba ..... E01C 23/065 172/196
5,140,763 A * 8/1992 Nichols, IV ..... E01H 5/062 37/233
5,819,443 A * 10/1998 Winter ..... E01H 1/105 37/233
6,892,482 B2 * 5/2005 Harding ..... E01H 5/066 37/405
6,996,925 B2 * 2/2006 Harding ..... E01H 5/066 37/405
7,891,121 B2 * 2/2011 Smoljo ..... E02F 3/8155 37/447
9,707,597 B2 * 7/2017 Zwerner ..... E01H 1/02

FOREIGN PATENT DOCUMENTS

DE 38 13 090 A1 * 11/1988

* cited by examiner

*Primary Examiner* — Gary S Hartmann
(74) *Attorney, Agent, or Firm* — Gulf Coast Intellectual Property Group

(57) ABSTRACT

A road clearing apparatus that is configured to dislodge snow and ice from a surface of a roadway. The road clearing apparatus includes a housing that is operably secured to a rear of a motor vehicle. The housing is manufactured from a rigid material and includes a first end and a second end. The housing has a plurality of apertures that are formed in the top wall and bottom wall, wherein the plurality of apertures are axially aligned. Operably coupled with the plurality of apertures are rod members. The rod members are movable intermediate a first position and a second position wherein in the second position the rod members are extended downward from the housing so as to engage a roadway surface. Actuators are operably coupled to the rod members and are configured to provide movement thereof. A controller is present to provide an operational interface.

6 Claims, 2 Drawing Sheets

ROAD CLEARING APPARATUS

FIELD OF THE INVENTION

The present invention relates generally to road maintenance devices, more specifically but not by way, a road clearing apparatus that is configured to dislodge snow and/or ice that is superposed a road surface wherein the present invention is operably coupled to a suitable vehicle and operable to engage the road surface as the vehicle traverse therealong.

BACKGROUND

As is known in the art, in various regions of the world an accumulation of snow and/or ice can occur on roadways. Driving in wintery conditions causes thousands of accidents and vehicular deaths every year. The minimized friction results in a reduced ability to control a vehicle in these wintry conditions. Depending upon the area and municipality various methods are employed to control the condition of the roadways and improve travel thereon. Many regions will deploy salt or a mixture of salt/sand on the snow/ice in order to provide improved conditions. As is known in the art, the salt provides melting of the ice while the sand provides improved traction.

Another technique for controlling wintry roadway conditions is plowing. Plowing typically involves specialized equipment and/or vehicles that are equipped with hydraulically operated plows mounted to the front of the vehicle. Smaller applications for parking lots and similar areas often utilize plows attached to conventional pickup trucks. Larger plows are utilized by municipalities for clearing roadways. While plows have proven to be effective it is common for these devices to still leave behind a thin layer of snow and/or ice.

Accordingly, there is a need for a road clearing apparatus that is configured to provide dislodging of snow and/or ice superposed on a roadway wherein the apparatus is configured to be secured to or part of the rear bumper of a vehicle and provides substantial dislodging of snow and/or ice superposed the roadway surface.

SUMMARY OF THE INVENTION

It is the object of the present invention to provide a road clearing apparatus that is configured to provide dislodging of snow and/or ice superposed on a road way surface wherein the present invention is either incorporated into or secured to a rear bumper of a motor vehicle.

Another object of the present invention is to provide a snow and ice removal apparatus that is operable to displace snow and/or ice from a roadway surface wherein the present invention includes a housing manufactured from a rigid material such as but not limited to steel.

A further object of the present invention is to provide a road clearing apparatus that is configured to provide dislodging of snow and/or ice superposed on a road way surface wherein the housing includes a top surface and a bottom surface having aligned apertures journaled therethrough in a single row across the housing intermediate the ends thereof.

Still another object of the present invention is to provide a snow and ice removal apparatus that is operable to displace snow and/or ice from a roadway surface wherein the housing includes an interior volume.

An additional object of the present invention is to provide a road clearing apparatus that is configured to provide dislodging of snow and/or ice superposed on a road way surface wherein a plurality of rod members are movably mounted within the interior volume of the housing.

Yet a further object of the present invention is to provide a snow and ice removal apparatus that is operable to displace snow and/or ice from a roadway surface wherein the rod members are movable intermediate a first position and a second position.

Another object of the present invention is to a provide a road clearing apparatus that is configured to provide dislodging of snow and/or ice superposed on a road way surface wherein the rod members are operably coupled with actuators wherein the actuators are configured to provide movement of the rod members.

An alternate object of the present invention is to provide a snow and ice removal apparatus that is operable to displace snow and/or ice from a roadway surface wherein the rod members are configured to move through the plurality of apertures.

Still a further object of the present invention is to provide a road clearing apparatus that is configured to provide dislodging of snow and/or ice superposed on a road way surface wherein in the second position the rod members are extended downward from the housing so as to engage the surface of the roadway.

An additional object of the present invention is to provide a snow and ice removal apparatus that is operable to displace snow and/or ice from a roadway surface wherein the rod members are manufactured from steel cable.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
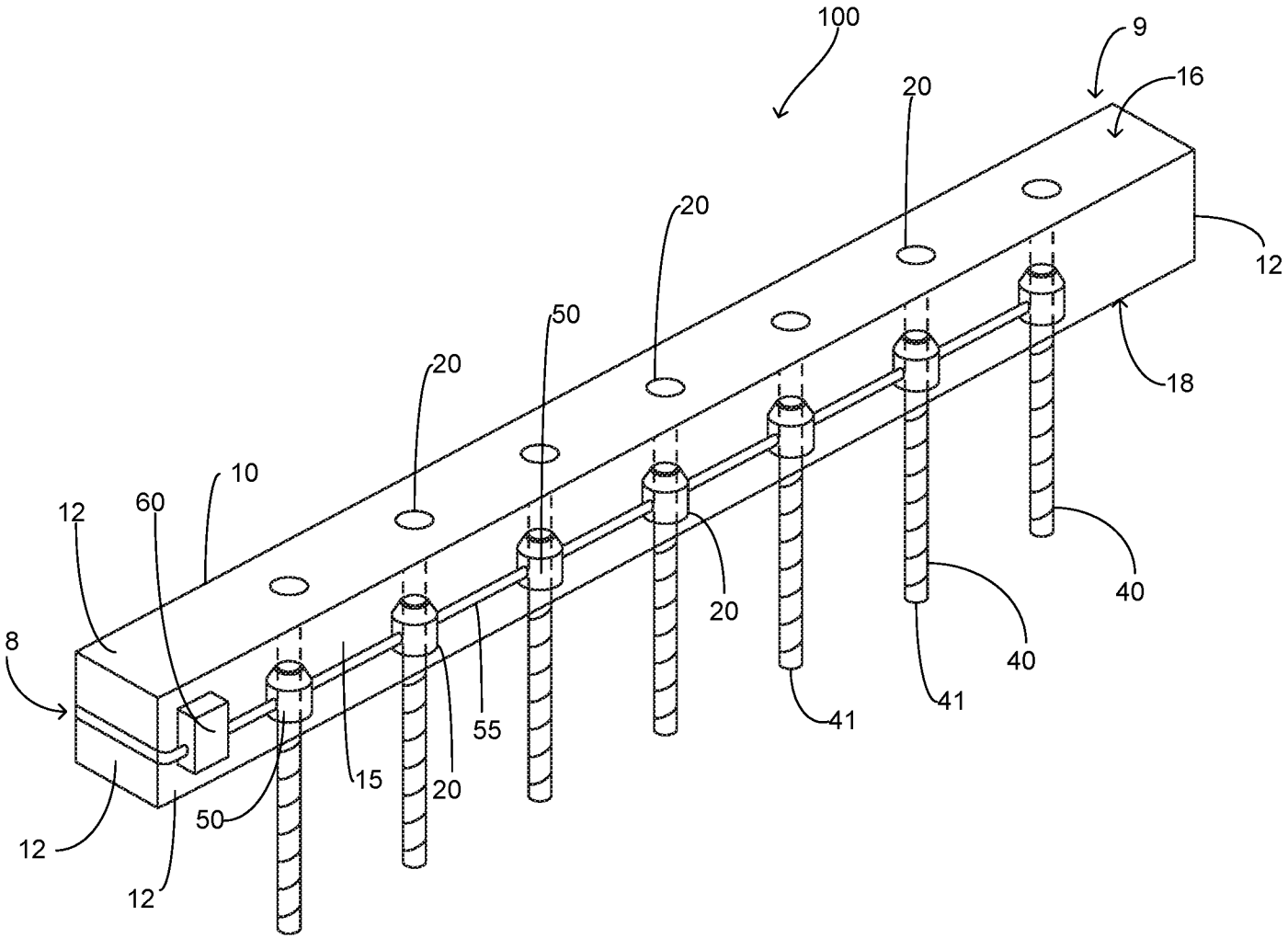
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated a road clearing apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the road clearing apparatus 100 further includes a housing 10. The housing 10 is generally rectangular in shape and is manufactured from a suitable durable material such as but not limited to steel tubing. The housing 10 is formed utilizing a plurality of walls 12 that are contiguous wherein the walls 12 are operable to define the interior volume 15 of the housing 10. The housing 10 is manufactured in a first embodiment or a second embodiment. In the first embodiment the housing 10 is manufactured so as to be the primary rear bumper of the exemplary vehicle 99 to which the road clearing apparatus 100 is secured. In its second embodiment, the housing 10 is manufactured so as to be releasably secured to an existing bumper on an exemplary vehicle. It is contemplated within the scope of the present invention that the housing 10 could be manufactured in various lengths in order to be of appropriate size for the vehicle 99 to which it will be mounted.

Formed in the top wall 16 and bottom wall 18 of the housing are a plurality of apertures 20. The apertures 20 are arranged in a single row extending substantially intermediate the first end 8 and second end 9 of the housing 10. The apertures 20 on the top wall 16 and bottom wall 18 are axially aligned so as to permit movement of the rod members 40 as will be further discussed herein. It should be understood within the scope of the present invention that the housing 10 could have various quantities of apertures 20. Furthermore, it is contemplated within the scope of the present invention that the housing 10 could have parallel rows of apertures 20 and wherein the parallel rows of apertures could be offset with adjacent row of apertures 20. It is additionally contemplated within the scope of the present invention that the apertures 20 could be formed in alternate sizes in order to accommodate rod members 40 of various diameters.

Figure 2:
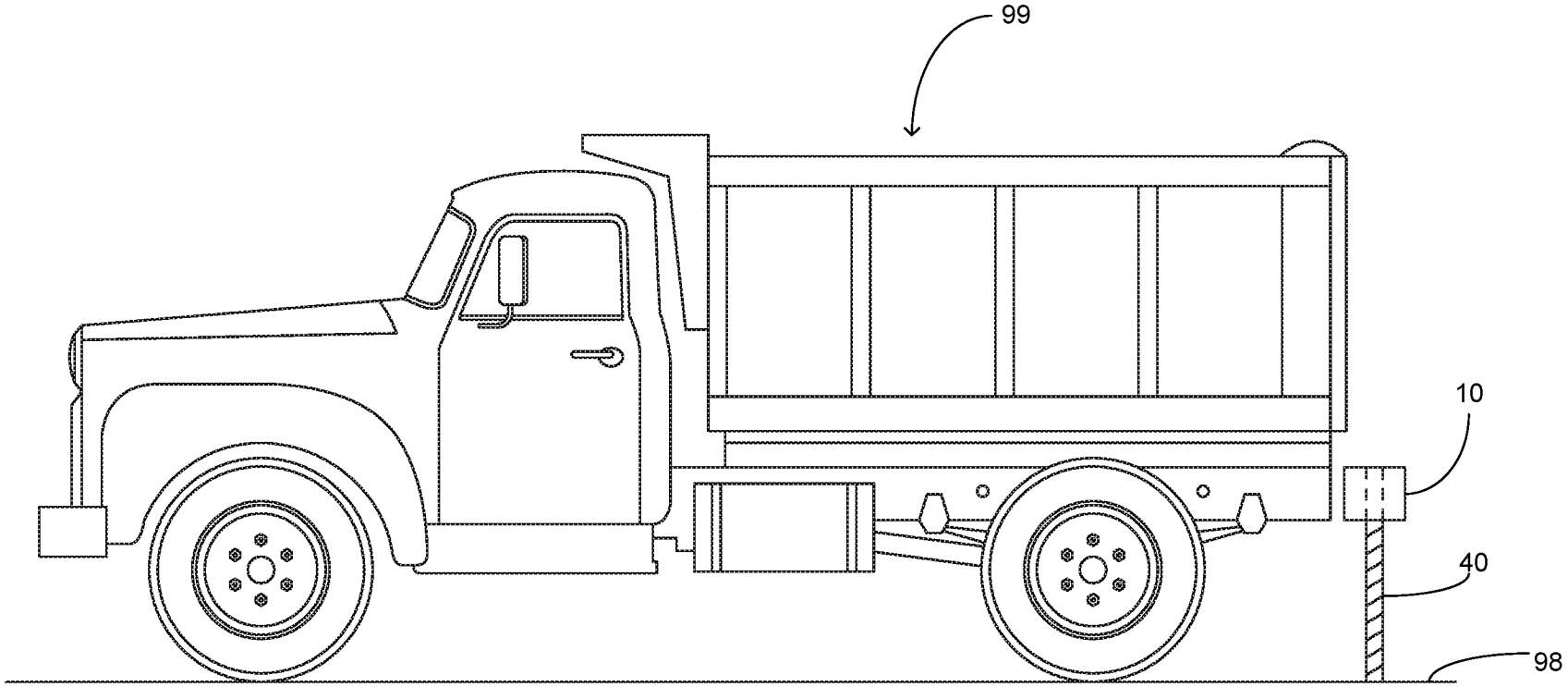
FIG. 2 is a side view of an embodiment of the present invention secured to a motor vehicle.

Disposed within the interior volume 15 of the housing 10 are a plurality of rod members 40. The rod members 40 are configured to be movable intermediate a first position and a second position. In the second position, as shown herein in FIG. 2, the ends 41 of the rod members 40 are operable to engage a surface 98 of a roadway while the vehicle 99 is in motion. As the vehicle 99 traverses across the roadway, the ends 41 of the rod members 40 frictionally engage therewith and function to dislodge any accumulated material thereon such as but not limited to ice or snow. In the first position of the rod members 40 are moved in an upwards direction so as to disengage with the surface 98 of the roadway. The rod members 40 in a preferred embodiment are manufactured from steel cable. Utilizing a material like steel cable allows some flexing of the rod member 40 in the event of contact with an immovable object so as to inhibit damage to the housing 10. It should be understood within the scope of the present invention that alternate materials could be employed and that various diameters of the rod members 40 could be utilized. The rod members 40 are manufactured of a suitable length in order to facilitate engagement of the end 41 with the surface 98 of the roadway when the rod members 40 are in the second position.

The rod members 40 are operably coupled to actuators 50. The actuators 50 are operably coupled with the rod members 40 so as to facilitate the movement thereof intermediate the first position and the second position. While the embodiment illustrated herein of the actuators 50 are hydraulic fluidly coupled with line 55 to controller 60, it is contemplated within the scope of the present invention that the actuators 50 could be electrical, mechanical or hydraulic so as to facilitate the movement of the rod members 40 intermediate their first position and second position. It is further contemplated within the scope of the present invention that the road clearing apparatus 100 could employ only one actuator 50 that is configured to provide operation of all of the rod members 40. The controller 60 is operably coupled to controls (not illustrated herein) in the passenger cabin of the vehicle 99 so as to facilitate operation of the road clearing apparatus 100 therefrom. It is contemplated within the scope of the present invention that the controller 60 could be operably coupled to various electrical, mechanical or hydraulic system on the vehicle 99 in order to provide operation of the road clearing apparatus 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A road clearing apparatus configured to be secured to a motor vehicle and provide clearing of snow and ice from a roadway surface comprising:

a housing, said housing being manufactured from a rigid material, said housing having a first end and a second end, said housing having a top wall, a bottom wall and a plurality of side walls integrally formed to create an interior volume, said housing having a plurality of apertures formed in said top wall, said housing having a plurality of apertures formed in said bottom wall, said plurality of apertures formed in said bottom wall and said top wall being axially aligned, said housing configured to be secured to a rear portion of a motor vehicle;

a plurality of rod members, said plurality of rod members being operably engaged with said plurality of apertures formed in said top wall and said bottom wall of said housing, said plurality of rod members being movably coupled to said housing, said plurality of rod members movable in an upward-downward motion within said housing, said plurality of rod members having a first position and a second position, said plurality of rod members having a first end and a second end, said second end of said plurality of rod members configured to engage a ground surface, said plurality of rod members being cylindrical in shape, wherein said rod members are manufactured from a flexible steel cable;

at least one actuator, said at least one actuator operably coupled to said plurality of rod members, said at least one actuator configured to provide movement of said plurality of rod members intermediate said first position and said second position; and wherein said plurality of rod members are operable to engage a surface on which the vehicle is traversing in said second position thereof so as to dislodge material accumulated on the surface.

2. The road clearing apparatus as recited in claim 1, wherein said plurality of apertures on said top wall and said bottom wall of said housing are arranged in a row intermediate the first end and second end of the housing.

3. The road clearing apparatus as recited in claim 2, wherein the at least one actuator is selected from a group of the following: electrical, mechanical or hydraulic.

4. The road clearing apparatus as recited in claim 3, wherein said at least one actuator is operably coupled to a controller, said controller configured to interface with controls in a passenger cabin of the vehicle.

5. The road clearing apparatus as recited in claim 4, wherein said housing is rectangular in shape and manufactured from steel tubing.

6. The road clearing apparatus as recited in claim 5, wherein in said first position said plurality of rod members are partially retrieved into said interior volume of said housing.

* * * * *